US006161740A

United States Patent [19]

Allen

[11] Patent Number: 6,161,740

[45] **Date of Patent: *Dec. 19, 2000**

[54] WRIST MOUNT FOR ROTATABLE SPECIAL RECEPTACLE PLATFORM FOR SMALL ELECTRONIC DEVICES AND TRAY HOLDER FOR CARD GRAPHICS

[75] Inventor: Robert P. Allen, Hagerman, Id.

[73] Assignee: Brandy Benjamin, Savoy, Ill.

[ * ] Notice: This patent is subject to a terminal disclaimer.

[21] Appl. No.: 09/476,648

[22] Filed: Dec. 31, 1999

Related U.S. Application Data

[63] Continuation-in-part of application No. 09/058,998, Apr. 13, 1998, Pat. No. 6,016,942, and a continuation-in-part of application No. 09/388,407, Sep. 1, 1999.

[51] Int. Cl.[7] ..... A63B 69/00

[52] U.S. Cl. ..... 224/197; 224/219; 434/250

[58] Field of Search ..... 224/197, 219, 224/222, 267; 434/250

[56] References Cited

U.S. PATENT DOCUMENTS

| | | | |
|---|---|---|---|
| 1,407,239 | 2/1922 | Weiss | 224/219 |
| 3,550,824 | 12/1970 | Bohanski | 224/197 |
| 3,942,194 | 3/1976 | Winter | 224/219 |
| 4,746,043 | 5/1988 | Booker | 224/219 |
| 5,309,328 | 5/1994 | Lum | 224/222 |
| 5,531,481 | 7/1996 | Wiltshire | 224/219 |
| 5,810,220 | 9/1998 | Petersen | 224/222 |
| 5,988,577 | 11/1999 | Phillips et al. | 224/197 |

*Primary Examiner*—Stephen P. Garbe

[57] ABSTRACT

A snap-fit assembled wrist mount for special receptacle rotatable tray holders for graphics and special receptacle rotatable platform holders for electronic devices.

6 Claims, 3 Drawing Sheets

WRIST MOUNT FOR ROTATABLE SPECIAL RECEPTACLE PLATFORM FOR SMALL ELECTRONIC DEVICES AND TRAY HOLDER FOR CARD GRAPHICS

CROSS REFERENCE TO RELATED APPLICATIONS

This application is a continuation-in-part of prior application Ser. No. 09/058,998, filed Apr. 13, 1998, now U.S. Pat. No. 6,016,942 and a continuation-in-part of prior application No. 09/388,407, filed Sep. 1, 1999.

STATEMENT REGARDING FEDERALLY SPONSORED RESEARCH OR DEVELOPMENT—Not applicable.

REFERENCE TO MICROFICHE APPENDIX—Not Applicable.

BACKGROUND OF THE INVENTION

1. Field of the Invention

The original prior application invention, now U.S. Pat. No. 6,016,942, is a rotatable wrist mounted tray with side walls designed for holding sets of learning aid cards for ice skating dances. The 09/388,407 continuation-in-part application is for a partial variation of the prior design. The 09/388,407 variation receptacle is a rotatable wrist mounted platform without side walls, rather than a tray receptacle with side walls as in the prior application. The primary field of use for the rotatable wrist mount platform is for user simple mounting on the platform any of most of the various hand hold size electronic devices such as small visual display screen computers. This CIP-2 application is a continuation-in-part of the prior applications for the tray holder and for the platform holder. This application is for an improvement in the wrist mount part of the receptacles, which improvement enables more economical assembly of the mount to the holders and results in improved holders.

2. List of Related Art cited

| U.S. PATENT DOCUMENTS | | | |
|---|---|---|---|
| 1,407,239 | 2/1922 | Weiss | 224/219 |
| 5,810,220 | 9/1998 | Peterson | 224/222 |
| 2,099,295 | 11/1937 | Canfield | 224/255 |
| 3,550.824 | 12/1970 | Bohanski | 224/219 |
| 4,903,932 | 2/1990 | Stewart, Jr. | 224/267 |
| 5,386,933 | 2/1995 | Greene et al. | 224/219 |
| 5,531,481 | 7/1996 | Wiltshire | 224/219 |
| 5,810,220 | 9/1998 | Peterson | 224/222 |
| FOREIGN PATENT DOCUMENTS | | | |
| 70,777 | 2/1916 | Switzerland Maisch | 224/219 |

3. Description of the Related Art

The reference documents are related to the application of this invention in that several pertain to a device for holding something on a wrist. Differences from the subject invention which are common to each of the references is that none of them in their specific styles or size proportions are usable for mounting the current or anticipated future variety of hand hold size small electronic devices, or of holding the cards for which the tray holder is designed.

The foreign patent of 1916 by Maisch of Switzerland is for a leather wrist mount sketch and note pad holder with pencils. Had the designer intended to display individual printed graphics or electronic devices had they then existed, he could have if he would have sized such displays to fit his holder. However his holder concept would not accept the size of graphics or electronic devices that the subject invention is designed for, and his holder does not provide for rotatable viewing orientation.

The U.S. 1922 patent by Weiss is for a wrist mount holder for paper or erasable reusable surface note pad with pencil, and an openable windowed protective cover for writing through the windows. The concept did not contemplate holding otherwise printed graphics or electronic devices as provided for by the subject invention device.

The U.S. 1937 patent by Canfield is for a wrist mount holder for miniature paper note pads from which used sheets can be removed. The concept did not contemplate holding otherwise printed graphics or electronic devices as provided for by the subject invention device.

The U.S. 1970 patent by Bohanski is for a wrist mount rotatable holder for flashlights. The wrist mount purpose is similar to the hands freeing function of the subject invention device. And the rotatable purpose is similar to the direction orienting function of the subject invention device, except that Bohanski's rotation is held in increments of orientation by a circle of spaced mechanical bumps on its mount plate, whereas the rotation of the subject invention device is infinite as to position setting. The rotatable position hold function of the subject invention is considered to be an improvement over Bohanski's concept and that of other rivet and nut/bolt types of rotation fastenings of holders to wrist mounts, for the following reasons. The invention device any position holding functions through the close mating and surface friction between six relatively large diameter disk surfaces that are part of the wrist mount to holder assembly, as will be further explained below and through the drawings. Also the large diameters of the disks and their large diameter joining stem provide strong fastening strength, with parts that do not tear out of plastic surfaces with use such as normal diameter metal rotational fasteners can.

The U.S. 1976 patent by Winter is for a prosthetic device for handicapped persons. That the holder rotates is a principal feature of the device. Similar to the disks braking function of the subject invention, two disks with a plurality of mechanical stop positions lock against each other to maintain position. The holder intended for hand implements such as a toothbrush and eating tools of a handicapped person whose hands cannot hold the items, would not be able to hold the graphic cards or an electronic device that the subject invention is designed for.

The U.S. 1988 patent by Booker is for a transparent plastic enclosure for devices such as calculators, that can be mounted on a wrist but cannot be rotated on the wrist. Operation of a calculator on a wrist can be by pressing the device keys through the plastic. Protection of the device is a primary function of the enclosure. This invention could accomodate the size of many of today's electronic devices, but most of the devices are designed for open face use and would not work well through a plastic enclosure. The design of the subject invention platform version rotatable holder is capable of mounting the variety of current and anticipated future hand hold size electronic devices.

The U.S. 1990 patent by Stewart is for a thigh mounted holder for such as relatively large writing tablet clip boards used while seated. That the tablet holder rotates is a principal feature of the device. Eight optional position direction positions are available. The position locking device and the mount to holder fastening are strong, related to the large clip board and the strength of a leg thigh. The mechanisms are too strong and too elaborate relative to the simple light weight parts of the subject invention platform holder for use on wrists.

The U.S. 1994 patent by Lum is for a handsfree forearm strap for portable electronic equipment. The strap provides one side of a hook and loop mating system for mounting various equipment. Rotation is not possible. The subject invention platform version holder provides rotation and greater flexibility for mounting devices.

The U.S. 1995 patent by Greene is for mounting protectively transparent laminated ski run area maps on wrists. The laminated sandwich has cuts in the back sheet which accept wrist mounting straps. The sandwich flex curves over the wrist and its clothing. Similar to what professional football quarterbacks and coaches are presently using for play referencing. Other graphics could be individually handled with such a concept, but not equivalent to the subject invention holder with its flat graphics feature, capability for mounting small electronic devices, and rotatable features.

The U.S. 1996 patent by Wiltshire is for a small in area but relatively high miniature wrist mount memo pad device with pencil. The height of the device relates to its having a stack of miniature file drawers for storing miniature writing paper and written memos. There are several additional elaborate features on this device, but none that would reasonably relate to the rotatable platform for mounting graphic displays and hand hold size electronic devices features of the subject invention holder.

The U.S. 1998 patent by Petersen is for a small portable sorting tray for mail workers. The tray mounts on the underside of a forearm above the wrist and is rotatable. The tray mounted on the underside of the forearm permits the hand on that arm to participate in holding letter envelope sorting. A metal bolt with washers fastens the tray to the arm mount and brake holds rotation through its providing compression between mating surfaces. This fastener/position holding method is mechanically natural and is similar to that used for early versions of the subject invention holder. The present design for the rotation and fastening of the subject holder is a significant improvement, as outlined under patent by Bohanski above.

The U.S. 1999 patent by Phillips is for a carrier assembly for a wireless communication device that can be mounted on a belt or other article of clothing. There is a rotation feature with a plurality of position options. The carrier is a set size and shape related to some mobile phones. The carrier would be too heavy and bulky for wrist mounting, and too limited for device options compared to the platform version rotatable wrist mount holder of the subject invention.

The above reference documents are indirectly related to the application of this invention in that several pertain to a device for holding something on a wrist. None of their designs are capable of mounting electronic devices or of displaying the graphics for which this holder is sized. The invention's open platform capable of mounting the variety of current and anticipated future hand hold size electronic devices, and the tray capable of holding sets of graphics for numerous subjects, including the skater learning aid cards designed for the tray holder, the holder's rotate mechanism, and its thin light weight plastic section including the platform which can be shears trimmed by a user to suit a particular electronic device, are improvements over the indirect references.

The U.S. 2000 patent by Allen is for a special receptacle which mounts on a user's wrist for holding and displaying visual aids as used by ice skaters. The patented device which is a rotatable wrist mounted tray with side walls designed for holding sets of learning aid cards for ice skating dances, is a directly related prior application. A related new application is a continuation-in-part of the prior application. The continuation-in-part application is for a partial variation of the prior design. The variation receptacle is a rotatable wrist mounted platform without side walls, for holding hand hold size electronic devices, rather than a tray receptacle with side walls for holding sets of visual aids as in the prior application. The platform application can also be used to hold one at a time the learning aid cards that the tray application is designed to hold as a set.

The prior invention's open platform capable of mounting the variety of current and anticipated future hand hold size electronic devices, and capable of mounting individual graphics for any variety of subjects including the skater learning aid cards designed for the cross referenced tray holder, the platform holder's rotate mechanism, and its thin light weight plastic section including the platform which can be shears trimmed by a user to suit a particular electronic device, are, for holding electronic devices, improvements over the indirect references and the direct reference prior application.

The present invention is a continuation-in-part of both the Allen tray application and the Allen platform application. The present invention improves the rotatable mount for both a tray holder and a platform holder. The improvement enables more economical assembly of the mount to the holders. Savings come from being able to use a wider selection of plastics than those that are restricted regarding chemical bonding or welding, not needing special equipment for bonding or welding, not having to meet safety and environmental regulations special to chemical byproducts of bonding and welding, less loss of parts to imperfections of bonding or welding, and no special labor skills as required by bonding or welding.

The present invention also improves the rotation/braking mechanism of the mount in that an additional, a sixth, frictional disk surface is provided by enclosing the rotation assembly between the holder and the wrist strap plate. This also provides an unbroken holder face.

BRIEF SUMMARY OF THE INVENTION

The present invention comprises an improved mount rotatable, wrist-mountable holder as a platform on which may be mounted small hand hold size electronic devices, or as a tray which may be used to hold individual or sets of appropriately sized card or paper graphics of any subject. The holder frees the hands of the user. The holder can be rotated on a user's wrist to orient an electronic or printed graphic for best viewing. All of the comers and edges of the holder are rounded so that it has no sharp edges.

This improved wrist mount continuation of the invention modifies the prior mount design. The principal modification and benefit of the present invention is that the mount elements that assemble together to hold the tray or the platform are designed for pressure snap together assembly rather than by chemical or weld bonding as previously designed.

DETAILED DESCRIPTION OF THE INVENTION

Figure 1:
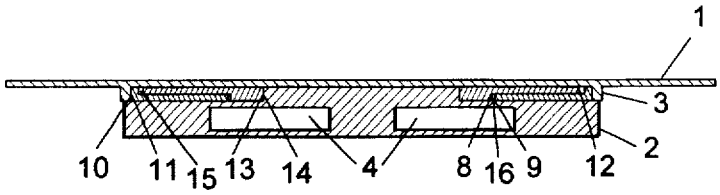
FIG. 1 is a cross section through line 1-1 in FIG. 2 of a holder secured on a mount assembly.
Figure 4:
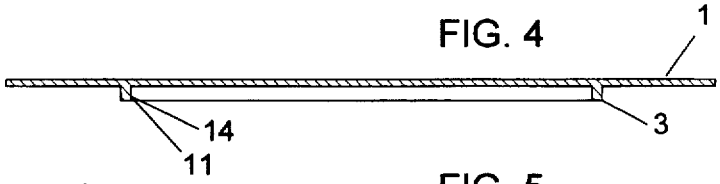
FIG. 4 is the holder part of the FIG. 1 cross section.
Figure 5:
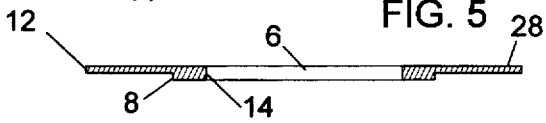
FIG. 5 is the rivet head ring part of the FIG. 1 cross section.
Figure 6:
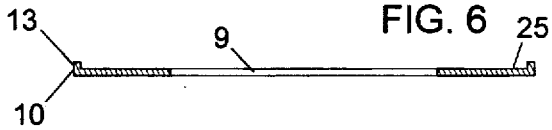
FIG. 6 is the rivet head retainer ring part of the FIG. 1 cross section.
Figure 7:
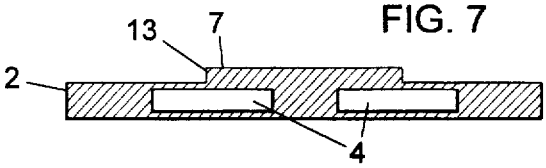
FIG. 7 is the rivet head and strap plate part of the FIG. 1 cross section.
Figure 3:
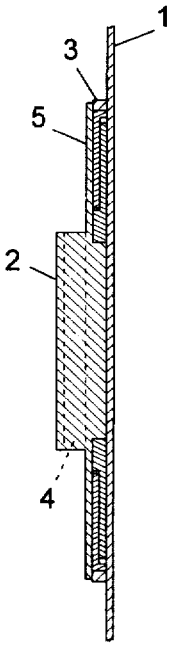
FIG. 3 is a cross section through line 3-3 of FIG. 2.
Figure 12:
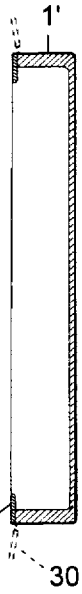
FIG. 12 is a cross section through line 12-12 of FIG. 10.

The holders, Platform Holder 1 (FIGS. 1,2,3,4,13,14,15, 16, 17, 18), and Tray Holder 1' (FIGS. 10,11,12) are formed from injection molded, shatterproof plastic material. The material is not brittle and not extremely rigid and may be either clear or colored. Both holders include a receiving ring 3 on their bottoms (FIGS. 1,2,3,4,11,14,17). The receiving ring 3 is for mating with and holding the rivet head retainer ring 25 (FIG. 6). A holder is attachable to a person's wrist by means of a wrist mount strap plate and rivet head part 2 (FIGS. 1,2,3,7) which rivet head 7 edge secures to the edge of hole 6 (FIG. 5). The rivet head ring bottom step 8 is held in a centered position by hole 9 in rivet head retainer ring 25 (FIG. 6), but a slight clearance between the edges of 8 and 9 provides for the wrist mount strap plate 2 rivet head 7 (FIG. 7) when secured to rivet head ring 28 (FIG. 5) to be rotatable. Rivet head retainer ring 25 edge 10 (FIG. 6) secures to receiving ring 3 (FIGS. 1,2,3,4) fastening the wrist mount assembly parts 7 (FIG. 7), 28 (FIG. 5), 25 (FIG. 6) to a holder 1 (FIG. 4). One side of the strap plate is a disk 5 (FIGS. 2,3) which covers and conceals the assembly of the parts of FIGS. 5 and 6. The comers 17 (FIG. 2) of the strap plate are rounded.

The mount assembly is hand rotatable but has sufficient friction between internal surfaces to hold positions. The wrist mount assembly parts are injection molded using the same or other plastic material as the holder. A pair of slot holes 4 (FIGS. 1,2,3,7) in the strap plate provide for the use of a pair of wrist straps which extend through the holes but are not permanately attached to the holder. The straps may be made of material such as plastic, leather, woven material and hook and loop material, and may be replaced by user. The straps fasten a rotatable holder directly to a wrist or over clothing on a wrist.

Figure 8:
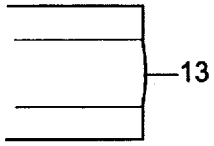
FIG. 8 is a ten times expansion of the edge bulge detail used in fastening the parts of FIGS. 4 and 6 together, and of FIGS. 5 and 7 together.
Figure 9:
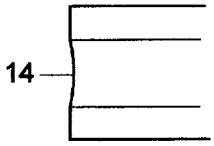
FIG. 9 is a ten times expansion of the edge recess detail which mates with the bulge of FIG. 8.
Figure 19:
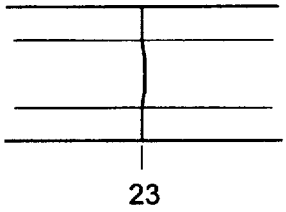
FIG. 19 is ajoining of FIG. 8 and FIG. 9.

Assembly of the wrist mount parts to each other and to a holder is simultaneous by pressure applied by a hand operated arbor press with the parts held in alignment by ajig. The securing of the edge of rivet head 7 (FIG. 7) to the edge of hole 6 (FIG. 5) is through a tight fit of bulge edge 13 (FIG. 8) on 7, and recess edge 14 (FIG. 9) on 6. The securing of edge 10 of rivet head retainer ring 25 (FIG. 6) to the inside edge 11 of holder 1 receiving ring 3 (FIG. 4 ) is through a tight fit of bulge edge 13 (FIG. 8) on 10, and recess edge 14 (FIG. 9) on 11. 23 (FIG. 19) is the jointing of 13 (FIG. 8) and 14(FIG. 9).

Figure 2:
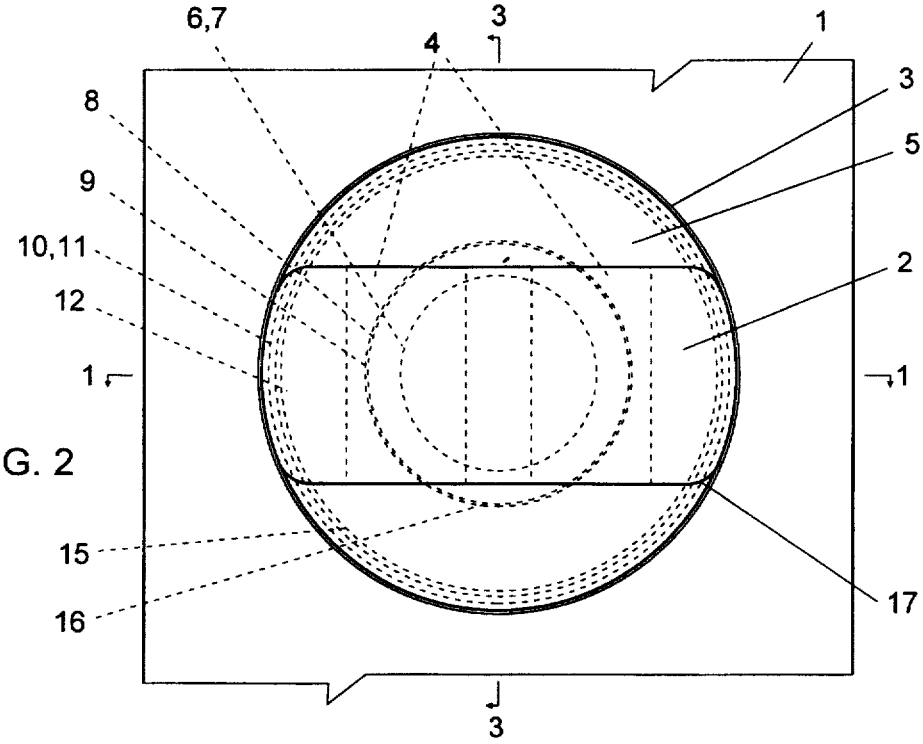
FIG. 2 is a plan view of the mount on the bottom of a holder.

FIG. 2 is a bottom view of a rotatable mount on a mid-section of Holder 1. Dashed line concentric circles in FIG. 2 indicate the above rotatable wrist mount parts in the assembly. 4 indicates the strap slots. 6,7 indicates the mated edges of 6 (FIG. 5) and 7 (FIG. 7). 8 indicates the flange edge of FIG. 5. 9 indicates the hole edge of FIG. 6 which shows a clearance 16 from 8. 10,11 indicates the mated edges of 10 (FIG. 6) and 11 (FIG. 4). 12 indicates the edge of rivet head ring 28 (FIG. 5) which shows 15 a clearance from the inside of retainer ring 25 (FIG. 6).

Figure 10:
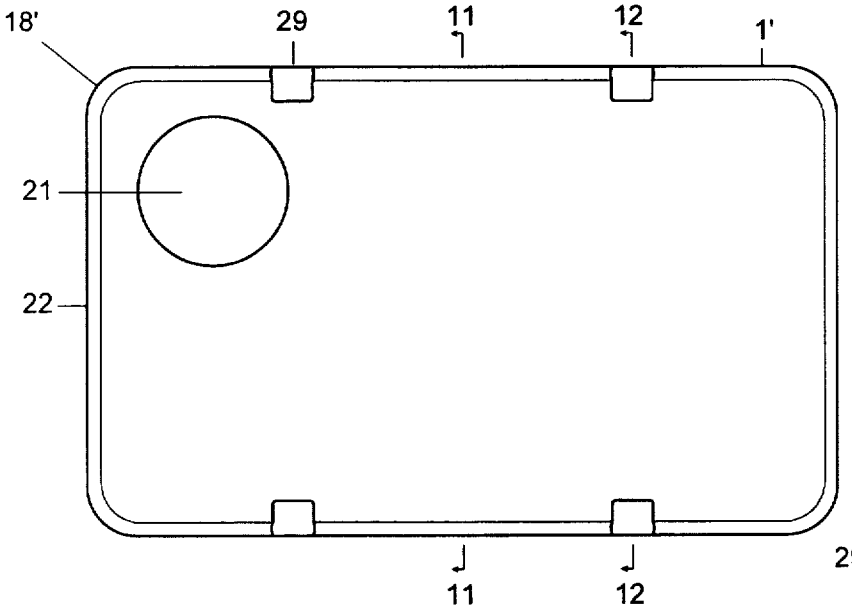
FIG. 10 is a 65% scale top plan view of a platform holder.
Figure 11:
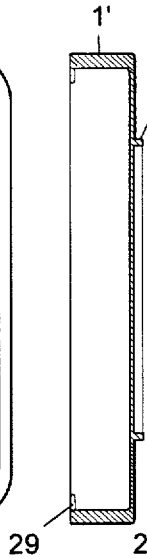
FIG. 11 is a cross section through line 11-11 of FIG. 10.
Figure 13:
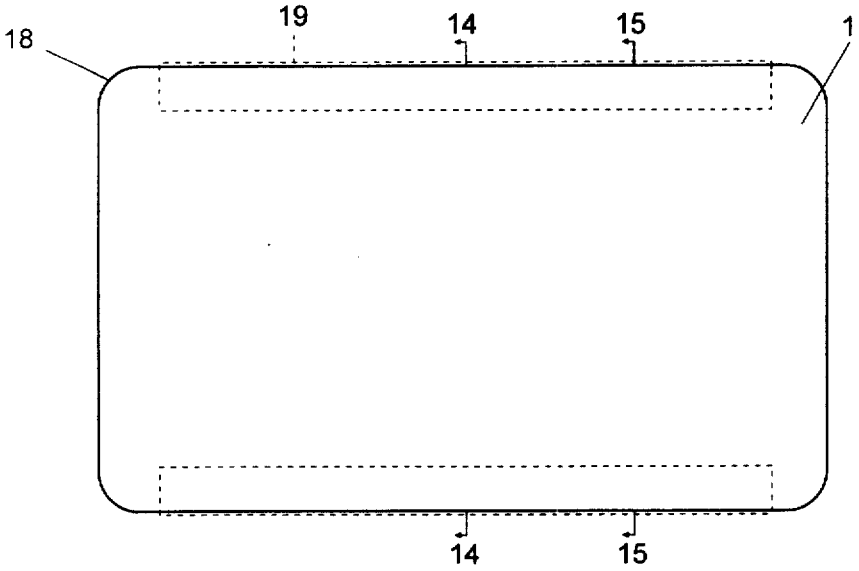
FIG. 13 is a 65% scale top plan view of a platform holder with graphics edge strips positions indicated.
Figure 14:
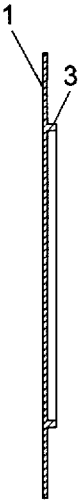
FIG. 14 is a cross section through line 14-14 of FIG. 13.
Figure 15:
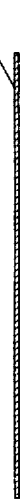
FIG. 15 is a cross section through line 15-15 of FIG. 13.
Figure 16:
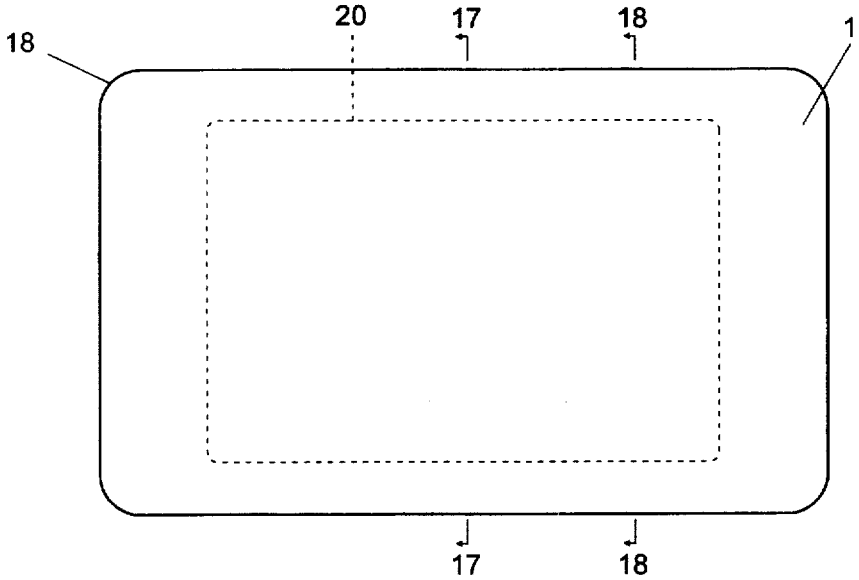
FIG. 16 is a 65% scale top plan view of a platform holder with an electronic device position indicated.
Figure 17:
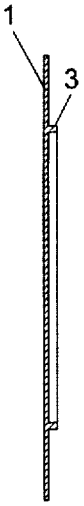
FIG. 17 is a cross section through line 17-17 of FIG. 16.
Figure 18:
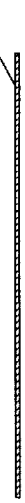
FIG. 18 is a cross section through line 18-18 of FIG. 16.

FIGS. 13 and 16 show in reduced scale a modification of the platform version of the holder of prior application CIP Application No. 09/388,407. FIG. 10 shows in the same scale a modification of the tray version of the holder of original Patent No. 6,016,942. The modifcation is to accomodate and take advantage of the improved mount of this CIP-2 application. When holders are made for this improved mount the mount per this CIP-2 completely replaces the mounts of the previous applications. For holders using this CIP-2 mount the cross sections (FIGS. 11,12) of FIG. 10 for the tray version holder and the cross sections (FIGS. 14,15) of FIG. 13 for the platform version holder and the cross sections (FIGS. 17,18) of FIG. 16 for the platform version holder, are in accordance with this improved mount. The snap fit assembly design lowers the cost of assembly. The design also encloses and conceals the rotation/brake holding elements of the mount.

The presently preferred sizing of the holders is for 4"×6.5" corner rounded cards. This size will also accomodate most presently available hand hold size electronic devices. Ghost outline 19 (FIG. 13) examples how a pair of stationers edge grip strips will slip fit on the platform to) hold card or paper graphic displays. The strip size required is one half of a one edge strip as normally used for gripping regular letter size matter.

Ghost outline 20 (FIG. 16) examples how the presently most popular hand hold electronic device would position on the platform holder. If a user wants to dedicate a platform for only one specific size of electronic device, the user may choose to trim cut the platform outline to match the outline of the electronic device. The plastic platform can be trimmed using a hand shears. Devices detachably mount on the platform by using sticky back hook and loop material patches or strips.

Each of the corners 18 (FIGS. 13,16) of the holder 1 is curved. Corners 18' of holder 1' (FIG. 10) are curved. All edges are rounded. The presently preferred thickness of the side walls 22 (FIG. 10) of tray holder 1' is 1/8 inch for safety. The presently preferred depth of the tray is for a set of 4 inch by 6.5 inch comer rounded cards which set may be a stack up to 1/2 inch thick.

Tabs 29 (FIG. 10) are hingedly attached to the upper edges of the side walls 22 by living hinges and loosely contain, for easy placement and removal, properly sized visual aid contents of the tray holder. The tabs snap into recesses in the top edges of side walls 22. When closed they project into the holder over the edges of the contents. 29 (FIGS. 10,11,12) illustrates the tabs in their closed positions in solid lines. 30 (FIG. 12) illustrates the tabs in their open positions in broken lines. A finger hole 21 (FIG. 10) facilitates removal of visual aids from the tray holder.

ROTATABLE WRIST HOLDER

RotaWrist

TRAY HOLDER

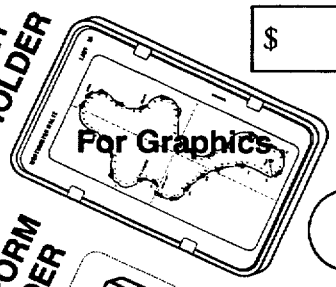

$

PLATFORM HOLDER

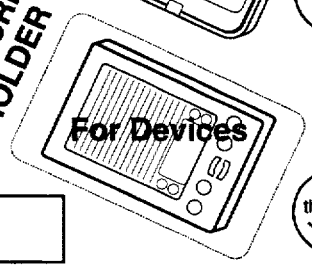

$ in this box

TRAY HOLDER
Designed for card graphics. One card or a set of cards.
For paper graphics a transparent lens is provided.
The lens can also be a template for cutting out graphics.
The card design size is 4 x 6.5 inches with 3/8 inch radius corner rounding.

PLATFORM HOLDER
For electronic devices. And/or for a card or paper graphic.
Reusable graphics holding edge strips are provided.
Adhesive hook & loop material is provided for holding devices.
The platform can be shears trimmed to the size of the device.

STRAPS
A pair of straps is provided. The straps can be cut to a length to fit a user's size and degree of wrist clothing.
The straps are not fixed to the holder. They pass through slots and are replaceable with other types by the user if preferred.

PROTECTIONS
Under the name of Robert P. Allen there is a patent pending for the holder and there are trademark registrations pending for LEGSPORT and RotaWrist.

LEGSPORT CORPORATION
18734 HIGHWAY 30, # 18
HAGERMAN, IDAHO 83332 USA
208-837-9025 Phone/Fax
E-Mail: legsport@magiclink.com Space for seller and bar code.

What is claimed is:

1. A rotatable wrist-mountable holder rotatably mountable on a person's wrist by means of a mount assembly, said mount assembly being secured to a receiving ring which extends downwardly from the bottom surface of the holder, said mount assembly comprising, a rivet head retainer ring edge-secured to the inner surface of the downwardly extending receiving ring, said rivet head retainer ring including a generally centrally located hole extending therethrough, a rivet head ring having a generally centrally located bottom step extending downwardly therefrom, said rivet head ring further including a generally centrally located hole extending through the bottom step, said rivet head ring being movably positioned between said rivet head retainer ring and the bottom surface of said holder, said bottom step extending into the hole in said rivet head retainer ring with a slight clearance between the bottom step and the edge of the hole in the rivet head retainer ring, said rivet head ring being rotatable with respect to the holder and the rivet head retainer ring.

a wrist mount strap plate having a rivet head extending upwardly therefrom, said strap plate having a slot hole extending therethrough for receiving a wrist strap, said rivet head being located within the hole in the rivet head ring, the edge of the rivet head being edge-secured to the edge of the bottom step surrounding said hole, whereby the wrist mount strap plate, the rivet head, and the rivet head ring are rotatable with respect to the holder and the rivet head retainer ring.

2. The rotatable wrist-mountable holder of claim 1 further including a small hand-hold-size electronic device secured thereto.

3. The rotatable wrist-mountable holder of claim 1 further including a plurality of slot holes extending through the strap plate for receiving two wrist straps.

4. The rotatable wrist-mountable holder of claim 1 wherein the holder comprises a tray for receiving visual aids, said holder having a bottom wall and a plurality of substantially vertical side walls extending around the perimeter of the bottom wall, a plurality of tabs hingedly attached to the side walls and extending inwardly of the holder, said tabs being movable between an open position in which visual aids may be inserted into the holder and a closed position in which the tabs will prevent visual aids contained in the holder from falling out.

5. The rotatable wrist-mountable holder of claim 4 wherein the holder and mount assembly are made from injection molded, shaterproof plastic material.

6. The rotatable wrist-mountable holder of claim 1 wherein the holder and mount assembly made from injection molded, shatterproof plastic material.

* * * * *